United States Patent [19]

Speck et al.

[11] 4,130,488

[45] Dec. 19, 1978

[54] DEVICE FOR CLEANING AND CIRCULATING A LIQUID

[75] Inventors: Walter Speck, Hilpoltstein; Willy Speck, Behringers-dorf, both of Germany

[73] Assignee: Speck-Pumpen Daniel Speck & Sohni, Germany

[21] Appl. No.: 809,804

[22] Filed: Jun. 24, 1977

[30] Foreign Application Priority Data

Sep. 3, 1976 [DE] Fed. Rep. of Germany ..... 2639854

[51] Int. Cl.[2] ..... B01D 27/08

[52] U.S. Cl. ..... 210/232; 210/323 T; 210/416R

[58] Field of Search ..... 210/416, 261, 258, 232, 210/323 T

[56] References Cited

U.S. PATENT DOCUMENTS

| | | | |
|---|---|---|---|
| 3,637,331 | 1/1972 | Smith et al. | 210/416 R X |
| 3,710,944 | 1/1973 | Budesheim | 210/261 |
| 4,052,317 | 10/1977 | Palnik | 210/416 R X |

*Primary Examiner*—Frank A. Spear, Jr.
*Attorney, Agent, or Firm*—Steinberg & Blake

[57] ABSTRACT

A device for cleaning and circulating a liquid includes a one-piece plastic body having a strainer housing portion for receiving raw liquid which is to be cleaned, a filter housing portion from which cleaned liquid is to be discharged, and a pump housing portion for housing a pump and formed with a pressure outlet communicating with the filter housing portion and through which pumped liquid is delivered to the filter housing portion to be filtered therein. This pump housing portion is also formed with a suction inlet for delivering liquid to a pump housed by said pump housing portion to be pumped thereby to the pressure outlet. The filter housing portion is formed with a passage communicating on the one hand with the suction inlet and on the other hand with the strainer housing portion, so that raw liquid received in the strainer housing portion will flow therefrom through this passage to the suction inlet.

16 Claims, 7 Drawing Figures

DEVICE FOR CLEANING AND CIRCULATING A LIQUID

BACKGROUND OF THE INVENTION

The present invention relates to devices for cleaning and circulating liquids.

There are certain installations which require liquid to be continuously cleaned, the liquid being received by the circulating and cleaning system in a raw form and being cleaned while being circulated and returned to the source of the raw liquid. For example, swimming pools require the liquid thereof to be circulated and cleaned in this manner.

It is already known to provide centrifugal pumps, including self-priming centrifugal pumps, which suck the liquid which is to be cleaned through a strainer while also filtering the liquid before the latter is returned to the source of the raw liquid. In this way it is possible to clean liquids, particularly water.

Systems of the above general type can be used with swimming pools of all types and sizes. Thus, systems of this type are used conventionally with public as well as private swimming pools.

With known installations of the above type, the pump is connected by way of a suitable pipe with the filter device, although a suitable hose may also be used for this purpose. The connection of the filter device to the pump by way of such a pipe or hose is however technically undesirable because of the costs involved, the space required, and the possible source of faulty operation resulting from such a connection. It is to be remembered that when a pipe or hose is used to connect a pump to a filter device, it is also required to provide faultless seals at the connections between the pipe or hose and the pump on the one hand as well as the filter device on the other hand.

As has been indicated above, a further disadvantage of such known systems resides in the relatively large amount of space required thereby. With many installations where it is desired to use a system of the above type, the required space is not available. Up to the present time it has been necessary to mount the pump as well as the filter device on a suitable foundation, most often a foundation which is common to the pump as well as the filter device, such as, for example, a suitable base plate. With such a construction during operation of the pump a considerable amount of undesirable noise is generated, this noise being intensified by the base plate which carries the structure.

SUMMARY OF THE INVENTION

It is accordingly a primary object of the present invention to provide a system of the above general type which will avoid the above drawbacks.

Thus, it is a more specific object of the present invention to provide a system of the above type which is extremely compact, being capable of being situated in an extremely small space which is far less than has been heretofore required for conventional systems of the above general type.

Furthermore, it is an object of the present invention to provide a system of the above type which does not require any pipes, hoses, or the like.

Moreover, it is an object of the present invention to provide a construction of the above type which does not require any foundation but which instead can be situated on any supporting surface, such as the ground adjacent a pool, for example, which has sufficient firmness. Such a support is usually available. For example, it is only required to situate the device of the invention on a relatively firm sod which is generally available at the region of a private plot of land where a swimming pool is mounted either on the ground or in the ground.

It is in addition an object of the present invention to provide a system of the above type which will render the pump and filter structures readily accessible for servicing, maintenance, and cleaning purposes. It is moreover, an object of the present invention to provide a construction of the above general type according to which the liquid will come into contact only with plastic or noncorrosive materials, so that in this way which might otherwise cause corrosion can be treated without any deterioration in the structure of the invention.

It is also an object of the present invention to provide a device of the above type according to which a strainer is readily accessible.

It is also an object of the present invention to provide a system of the above type which includes, except for units such as a pump, a strainer basket, and the filter structure per se, a one-piece plastic body which can be manufactured in a single operation such as by die-casting, for example.

Also it is an object of the present invention to provide a system of the above type which will not create any undesirable noise during operation of the system.

Furthermore it is an object of the present invention to provide a construction of the above type which will not create undesirable vibrations which might cause cracking or other damage in certain structural components.

A still further object of the present invention is to provide a construction of the above general type which is of a relatively light weight so that the device of the invention can easily be handled, transported, and packaged.

According to the invention, the device for circulating and cleaning a liquid includes a one-piece plastic body having a strainer housing portion for receiving raw liquid which is to be cleaned, a filter housing portion from which cleaned liquid is to be discharged, and a pump housing portion for housing a pump and formed with a pressure outlet communicating with the filter housing portion and through which pumped liquid is delivered to the filter housing portion to be filtered therein. This pump housing portion is also formed with a suction inlet for delivering liquid to a pump housed by the pump housing portion to be pumped thereby to the pressure outlet. The filter housing portion is formed with a passage communicating on the one hand with the suction inlet and on the other hand with the strainer housing portion, so that raw liquid received in the strainer housing portion will flow therefrom through this passage to the suction inlet.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
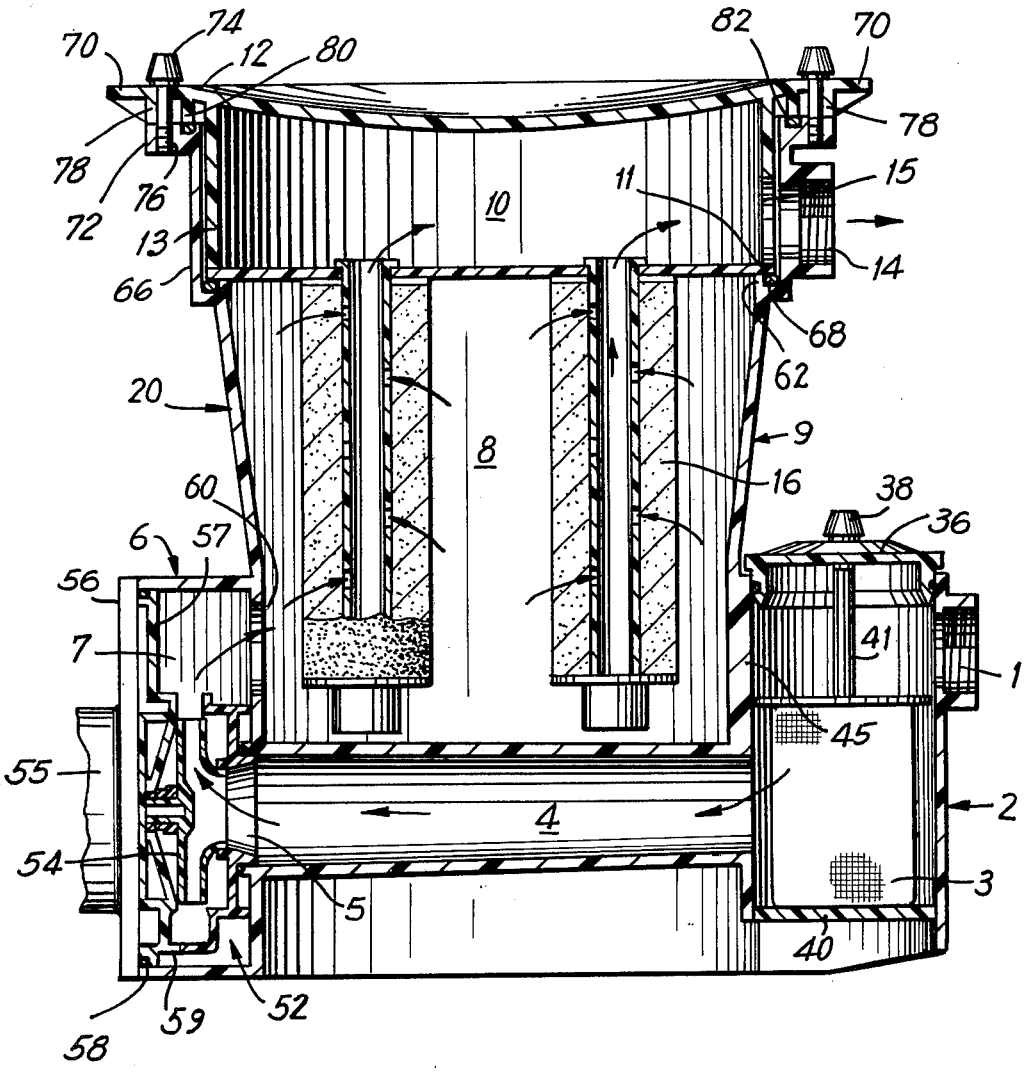
FIG. 1 is a sectional elevation of a device according to the invention, the section of FIG. 1 being taken along line 1—1 of FIG. 3 in the direction of the arrows.
Figure 2:
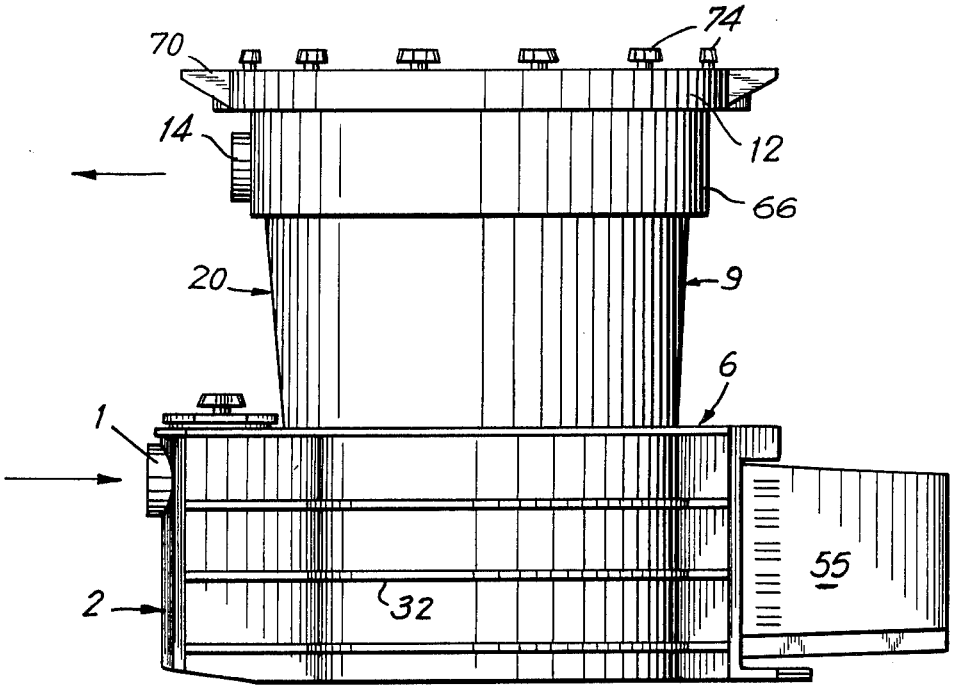
FIG. 2 is a side elevation of an embodiment of a device according to the invention.
Figure 3:
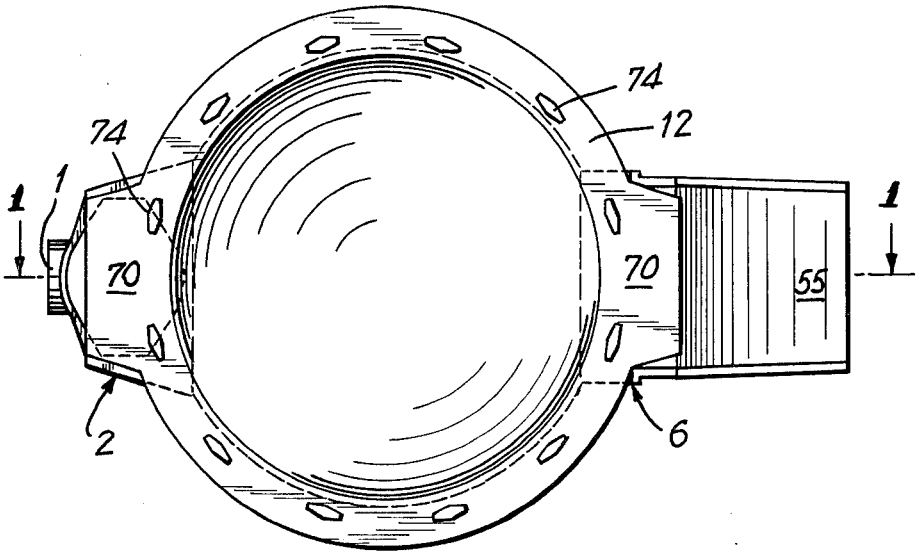
FIG. 3 is a top plan view of the device of FIG. 2.
Figure 4:
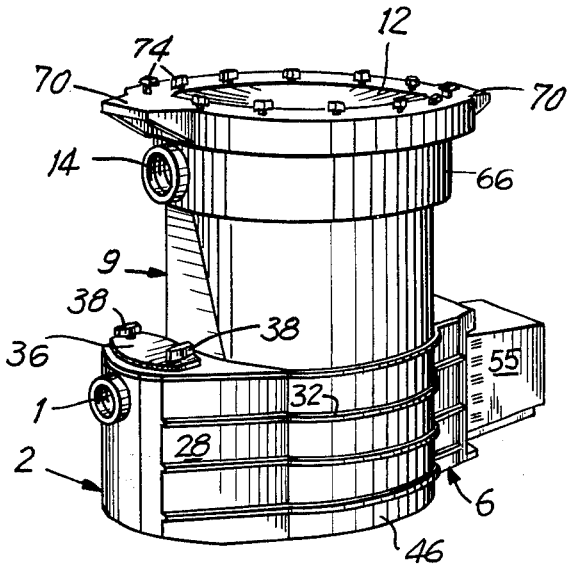
FIG. 4 is a perspective view of the structure of FIGS. 2 and 3.
Figure 5:
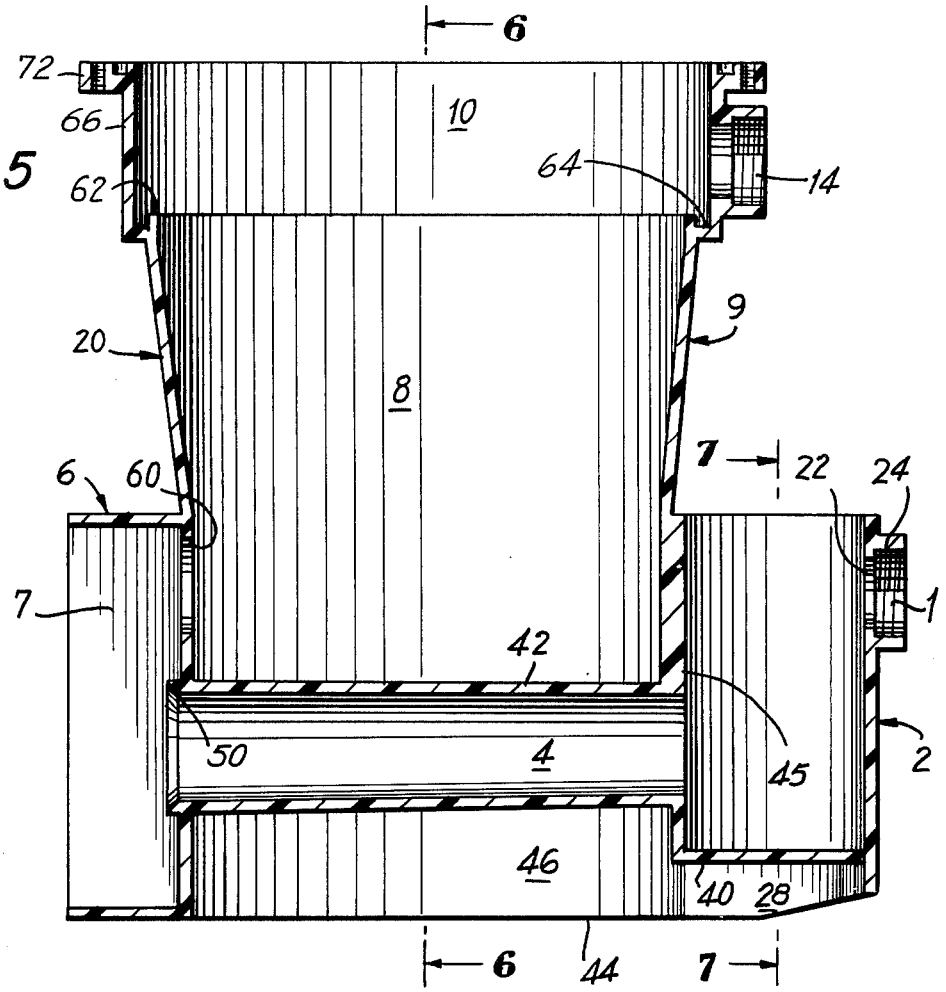
FIG. 5 is a sectional elevation of part of the assembly of FIG. 1, namely the part thereof which carries all of the other components.

Referring to FIGS. 1 and 5, there is illustrated therein a one-piece plastic body 20 which forms the primary supporting structure for all of the remaining components of the device of the invention. This one-piece plastic body 20 includes a strainer housing portion 2 which is formed at its upper right wall portion, as viewed in FIGS. 1 and 5, with an inlet 1 for receiving raw liquid. Thus, the inlet 1 includes an opening 22 formed in a wall portion of the body 20 as well as integral relatively short tubular extension 24 which is internally threaded so that a suitable fitting may be connected to the inlet 1, this fitting connecting a hose, for example, to the inlet 1 so that a raw liquid will flow through this hose and through the inlet 1 into the strainer housing portion 2 of the one-piece plastic body 20.

Figure 7:
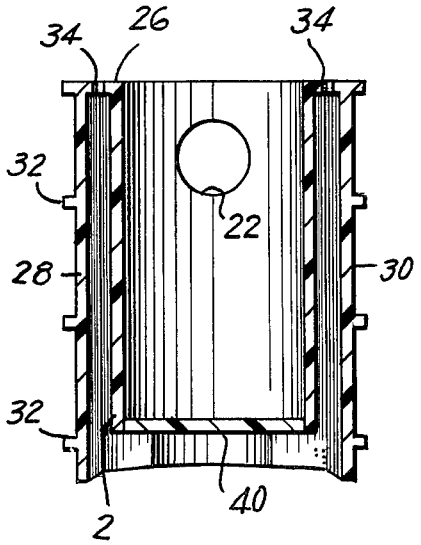
FIG. 7 is a transverse section of part of the structure of FIG. 5 taken along line 7—7 of FIG. 5 in the direction of the arrows.

As is apparent particularly from FIG. 7, the strainer housing portion 2 is in the form of a suitable well having an open top and depending integrally from a horizontal wall portion 26 which in turn is integral with outer side wall portions 28 and 30 of the one-piece plastic body 20. These side wall portions 28 and 30 are formed at their exterior with suitable reinforcing ribs 32. The horizontal wall portion 26 is formed with threaded openings 34 passing therethrough. A lid 36 is capable of cooperating with the strainer housing portion 2 in order to close the top thereof. This lid 36 is shown in FIG. 1 provided with a suitable sealing ring at the side wall of the lid which extends into the open top of the housing portion 2. The lid 36 has extensions which overlap the horizontal wall portion 26 and through which wing screws 38 extend to be threaded into the openings 34 in order to releasably connect the lid 36 with the strainer housing portion 2.

As is shown in FIG. 1, there is situated within the strainer housing portion 2, on the bottom wall 40 thereof a strainer basket 3 in the form of a cup-shaped member having an open top and being made of a suitable mesh material. This strainer basket 3 may be made of a suitable non-corrosive material such as stainless steel or a suitable plastic mesh. The upper periphery of the basket 3 is fixed with a bail or handle 41. It will be noted from FIG. 1 that the inlet 1 is situated slightly higher than the upper periphery of the basket 3 so that the entering raw liquid will flow from the inlet 1 into the interior of the basket 3 in the manner apparent from FIG. 1. Thus it is a simple matter whenever desired to unscrew the screws 38 so as to release the lid 36 which can be removed, thus rendering the basket 3 easily accessible. By way of the handle 41 it is a simple matter to remove the basket 3 and clean the latter before replacing the latter in the strainer housing portion 2.

The rear wall portion 45 of the strainer portion 2 is a wall portion which is in common with a filter housing portion 9 of the one-piece plastic body 20. As is particularly apparent from FIG. 6, the side walls 28 and 30 of the one-piece body 20 merge into and form part of the filter housing portion 9 of the body 20, this filter housing portion 9 being generally circular in cross section while tapering downwardly and having a bottom wall 42 situated above the lower edges 44 of a pair of side extensions 46 and 48 of the side walls 28 and 30, respectively. It will be noted that these lower edges 44 of the lower side wall portions of the body 20 are situated at an elevation lower than the bottom wall 40 of the strainer housing portion 2.

Figure 6:
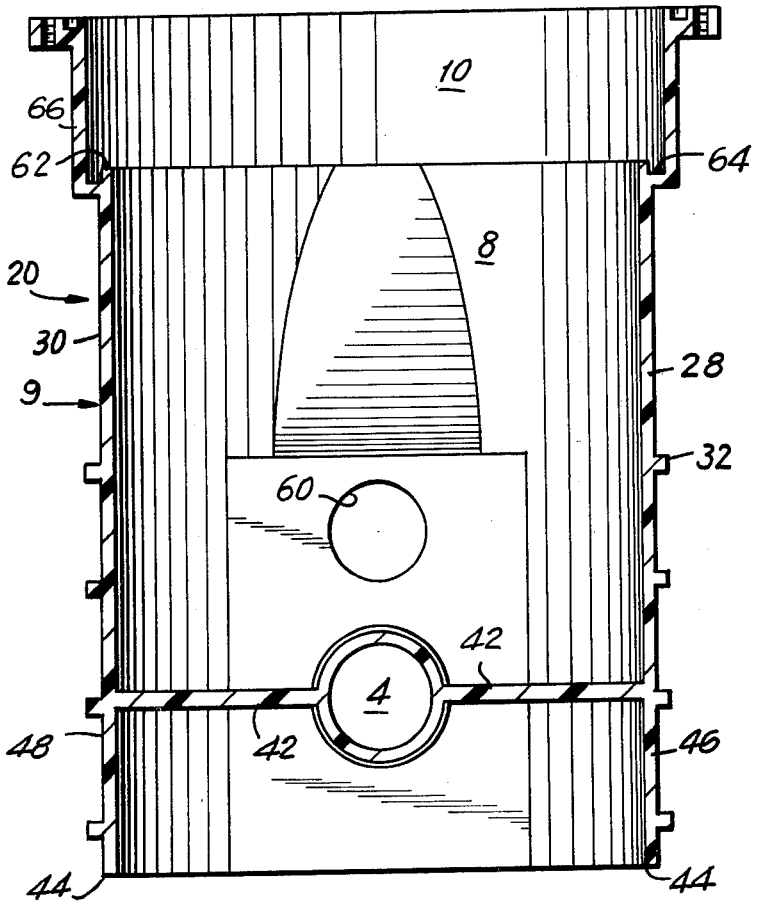
FIG. 6 is a transverse section of the structure of FIG. 5 taken along line 6—6 of FIG. 5 in the direction of the arrows.

Along the bottom wall 42 of the filter housing portion 9 the body 20 is formed with an elongated passage 4 in the manner apparent particularly from FIGS. 5 and 6. This passage 4 communicates at its right end, as viewed in FIGS. 1 and 5, with the strainer housing portion 2, so that the raw liquid after passing through the basket 3 will flow along the interior of the passage 4 to the left, as viewed in FIGS. 1 and 5.

The left lower part of the body 20, as viewed in FIGS. 1 and 5, is formed with a pump housing portion 6, the passage 4 forming at its left end, as viewed in FIGS. 1 and 5, a suction inlet 50 for the pump which is housed in the pump-housing portion 6. This suction inlet 50 is thus in the form of an opening formed in a wall of body 20 and communicating with one end of the passage 4.

The suction inlet 50 receives the inlet 5 of a centrifugal pump 52 illustrated in FIG. 1, this pump 52 being driven by a motor 55 which is mounted on a flange 56 which is fastened to the outer wall of the pump housing portion 6 in any suitable way. The inlet 5 of the illustrated pump is made of a plastic material, and the same is true of the impeller 54, the gland housing 57, and the volute 59 which are mounted in the pump housing portion 6 by way of a suitable sealing ring 58. Thus, the driving motor is connected with plastic components of the pump 52, and it is only these plastic components which contact the liquid received from the passage 4, this liquid being delivered to a pressure chamber 7 of the pump housing portion 6. This pressure chamber 7 communicates through an opening 60 with the interior 8 of the filter housing portion 9. Thus the opening 60 forms a pressure outlet for the pump 52.

As is apparent from FIGS. 1 and 5, the filter housing portion 9 includes in the interior of the body 20 an upwardly extending lip 62 forming the inner wall of a circular groove 64 the outer wall of which is formed by an upper outer wall portion 66 of the body 20. A suitable sealing ring 68 is situated in the groove 64 and engaged by the outer periphery of a filter-cartridge plate 11 which is made of a suitable plastic material and which rests on the lip 62 in the manner most clearly shown in FIG. 1. This cartridge plate 11 divides the interior of the filter housing portion 9 into the lower filter chamber 8 and an upper clean-liquid chamber 10. Thus, by way of the plate 11 these chambers are sealed from each other. The partition 11 carries in a known way filter cartridges 16 so that the liquid pumped through the pressure outlet 60 into the filter chamber 8 must pass through the filter cartridges 16 before reaching the clean-liquid chamber 10. The illustrated filters 16 may take the form of replaceable cartridges which are well known or they may take the form of filters which form from the filtered material which is trapped by the filter a filter cake through which the succeeding liquid is filtered while the cake builds, and of course when the filter cake reaches a certain magnitude the filter structure is replaced.

A closure means 12 is provided for closing the open top of the filter housing portion 9. This closure means 12 is in the form of a suitable lid made of a plastic material and having opposed ends 70 for facilitating grasping and handling of the closure means 12. At its periphery which extends over an upper flange 72 of the filter housing portion 9, the lid 12 is formed with a series of openings through which screws such as wing screws 74 respectively pass, these screws being capable of simply dropping into threaded openings 76 formed in the flange 72 so that the several wing screws 74 can easily be manually turned for connecting and disconnecting the closure means 12 from the filter housing portion 9. This closure means 12 has an outer downwardly extending lip 78 engaging the flange 72 adjacent the outer edge thereof, and an intermediate lip 80 which at its bottom edge presses against a sealing ring 82 situated in a groove which is formed in the flange 72 adjacent the wall 66.

Inwardly of the lip 80 the upper wall of the closure means 12 is integral with a downwardly extending endless side wall 13 which presses against the outer peripheral portion of the cartridge plate 11. Thus, by way of this construction the interior of the filter housing portion is effectively sealed.

Moreover, because in the position of the closure means 12 fixed to the housing portion 9 in the manner shown in FIG. 1 the side wall 13 presses downwardly against the plate 11, the latter effectively seals the filter chamber 8 from the clean-liquid chamber 10.

The filter housing portion 9 is formed at its upper right wall portion, as viewed in FIGS. 1 and 5, with a clean-liquid outlet 14 in the form of an integral tubular portion of the housing portion 9 which has an inner thread so that by way of a suitable fitting an elongated hose or pipe can be connected to the outlet 14. Also, the side wall 13 of the closure means is formed with an opening 15 which is aligned with the outlet 14. Thus the liquid in the clean-liquid chamber 10 can readily flow out through the opening 15 and outlet 14.

It is thus apparent that the straining pumping, and filtering operations are all united together by way of the single one-piece plastic body 20 of the invention. It will be noted that the pressure outlet 60 is formed in a part of the body 20 which has a wall portion in common with the pump housing portion 6 and the filter housing portion 9. Thus, all of the advantages of conventional systems of the above general type are retained by the structure of the invention. Thus the pump and filter structure are readily accessible for servicing, maintenance, and cleaning. The treated liquid comes only in contact with plastic components inasmuch as even the impeller 54 of the pump 52 is made of a plastic material, and of course the basket 3 may also be made of a plastic material, so that the treated liquid is effectively insulated from all parts of the electric motor 55. Moreover, since the liquid from its entrance into the strainer housing 2 all the way up to its discharge at the clean-liquid outlet 14 comes into contact only with plastic components, it is possible to treat corrosive liquids without damaging the pump assembly.

A particularly advantageous feature of the invention resides in the fact that the housing portions 2, 6, and 9 all have wall portions in common with each other. Moreover, the one-piece plastic body 20 which is shown in FIG. 5 can be die-cast, for example, in a single operation, so that the structure of the invention has a considerable advantage with respect to the low manufacturing cost thereof and ease of manufacture.

During operation of the structure of the invention, there is no generation of undesirable noise. This advantage is achieved by way of the plastic material utilized for the body 20, as well as the size and thickness of the walls thereof which serve to absorb undesirable noise. Moreover, the mass of liquid which is treated and flows through the structure during operation thereof prevents creation of vibrations which might be undesirably transmitted to surrounding structure and which might have a frequency which can create undesirable damage in certain structural components.

A further advantage of the structure of the invention resides in the fact that the entire system is of a relatively light weight, inasmuch as with the exception of the pump-driving motor 55, which is flanged onto the pump housing portion 6, the entire system is made of a plastic material.

In connection with the manufacture of the one-piece plastic body 20 of the invention, it is to be noted that in the interest of trouble-free removal of the molded plastic body from the mold in which it is formed, the entire structure illustrated in FIG. 5 is molded in one piece and in a single operation, with the exception of the bottom wall 40 of the strainer housing portion 2. This wall 40 is in the form of a circular disc of the same plastic material as the remainder of the body 20 but adjoined thereto, as by being welded thereto, subsequent to the molding of the remainder of the body 20. Thus, with the exception of this wall 40, the entire body 20 is molded in a single operation. It is apparent, therefore, that the one-piece plastic body 20 is substantially entirely in the form of a unitary wall structure incapable of being disassembled into subsidiary components.

Once the remaining structure is connected with the body 20, to provide an assembly as shown in FIG. 1, the entire device is ready for use. The body 20 can simply rest at its bottom edge 44 on any suitable sod or the like which is firm enough to support the structure so that no special foundation is required. Moreover, it will be seen that the inlet 1 for the raw liquid and the outlet 14 for the clean liquid are situated at the same side of the body 20 so that it is a simple matter to connect pipes, hoses, or the like to the inlet 1 and the outlet 14, this arrangement also contributing to the achievement of an exceedingly small space which is required for the system of the invention.

What is claimed is:

1. In a device for circulating and cleaning a liquid, a one-piece plastic body which substantially in its entirety is in the form of a unitary wall structure incapable of being disassembled into subsidiary components, said body having a strainer housing portion for receiving raw liquid which is to be cleaned, a filter housing portion from which cleaned liquid is to be discharged, and a pump housing portion for housing a pump and formed with a pressure outlet communicating with said filter housing portion and through which pumped liquid is delivered to said filter housing portion to be filtered therein, said pump housing portion also being formed with a suction inlet for delivering liquid to a pump housed by said pump housing portion to be pumped thereby to said pressure outlet, said filter housing portion being formed with a passage communicating on the one hand with said suction inlet and on the other hand with said strainer housing portion so that raw liquid received in said strainer housing portion will flow therefrom through said passage to said suction inlet.

2. The combination of claim 1 and wherein said strainer housing portion is formed with an inlet for raw liquid.

3. The combination of claim 1 and wherein a filter means is situated in said filter housing portion for filtering liquid delivered thereto, closure means for closing said filter housing portion, and connecting means releasably connecting said closure means with said filter housing portion.

4. The combination of claim 3 and wherein said filter means includes a plurality of filter cartridges.

5. The combination of claim 4 and wherein a cartridge-carrying plate carries said filter cartridges of said filter means and extends across said filter housing portion for dividing the latter into a lower filter chamber situated beneath said plate and an upper clean-liquid chamber situated over said plate and beneath said closure means, and said filter housing portion being formed with a clean-liquid outlet communicating with said clean-liquid chamber over said plate.

6. The combination of claim 5 and wherein said closure means includes an upper wall and a side wall extending downwardly from said upper wall and terminating in a lower edge engaging said cartridge-carrying plate and defining therewith the clean-liquid chamber which is situated within said filter housing portion, said side wall being formed with an opening through which liquid flows from said clean-liquid chamber to said clean-liquid outlet of said filter housing portion.

7. The combination of claim 6 and wherein said clean-liquid outlet of said filter housing portion is situated beneath said upper wall of said closure means and said opening in said side wall of said closure means being aligned with said clean-liquid outlet of said filter housing portion.

8. The combination of claim 1 and wherein said pressure outlet of said pump housing portion is formed in a wall of said body which is common to said pump housing portion and filter housing portion.

9. The combination of claim 1 and wherein said passage communicates with said strainer-housing portion at a wall portion of said body which is common to said strainer-housing portion and said filter housing portion.

10. The combination of claim 1 and wherein said filter housing portion has a bottom wall formed by part of said one-piece plastic body, and said passage extending along said bottom wall.

11. The combination of claim 10 and wherein said filter housing portion has a pair of diametrically opposed wall portions forming part of said filter housing portion and respectively situated at opposed ends of said passage where the latter respectively communicates with said strainer-housing portion and with said suction inlet of said pump housing portion, said pressure outlet being formed in the same wall portion as said suction inlet and being situated at an elevation higher than said suction inlet at a part of said one-piece plastic body which is common to said pump housing portion and said filter housing portion.

12. The combination of claim 1 and wherein said strainer housing portion has an open top, cover means covering said open top of said strainer housing portion, and a strainer basket situated in said strainer housing portion through which the raw liquid flows before reaching said passage, so that access to said basket is had upon removal of said cover means from said open top and said strainer housing portion.

13. The combination of claim 1 and wherein a pump means extends into said pump housing portion for pumping liquid from said suction inlet to said pressure outlet, said pump means consisting at all parts which contact liquid travelling from said suction inlet to said pressure outlet only of non-corrodable materials.

14. The combination of claim 1 and wherein a filter means is situated in said filter housing portion and forms in said filter housing portion a filter cake which builds in said filter housing portion and through which liquid is filtered.

15. The combination of claim 1 and wherein said strainer housing portion has a bottom wall which is fixed to the remainder of said one-piece plastic body.

16. The combination of claim 11 and wherein a pump means extends into said pump housing portion for pumping liquid from said suction inlet to said pressure outlet, and said pump means having a horizontal axis passing through the center of said suction inlet and coinciding with a central axis of said passage which extends along said bottom wall of said filter housing portion.

* * * * *